US006814631B2

(12) United States Patent
Baum et al.

(10) Patent No.: US 6,814,631 B2
(45) Date of Patent: Nov. 9, 2004

(54) ELECTRICAL TERMINAL FOR SURGE PROTECTION CARTRIDGE

(75) Inventors: Thomas Baum, Naperville, IL (US); Albert McGovern, Naperville, IL (US); Daniel Hoeft, Niles, IL (US); Jane Lee, Bloomingdale, IL (US)

(73) Assignee: Marconi Intellectual Property (Ringfence) Inc., Warrendale, PA (US)

( * ) Notice: Subject to any disclaimer, the term of this patent is extended or adjusted under 35 U.S.C. 154(b) by 0 days.

(21) Appl. No.: 10/114,138

(22) Filed: Apr. 2, 2002

(65) Prior Publication Data

US 2003/0186596 A1 Oct. 2, 2003

(51) Int. Cl.[7] ..... H01R 13/11
(52) U.S. Cl. ..... 439/857; 439/856
(58) Field of Search ..... 439/856, 857, 439/830, 248, 74.1, 74.2

(56) References Cited

U.S. PATENT DOCUMENTS 2,476,886 A * 7/1949 Miller et al. ..... 439/830
2,621,227 A * 12/1952 McMahon ..... 439/830

(List continued on next page.)

FOREIGN PATENT DOCUMENTS

EP 0753907 1/1997

*Primary Examiner*—Tho D. Ta
*Assistant Examiner*—Larisa Tsukerman
(74) *Attorney, Agent, or Firm*—Jones Day

(57) ABSTRACT

An electrical terminal and a system of the terminal and a housing is disclosed as an example of the present invention. The electrical terminal and the housing have a number of advantages including being sufficiently stiff to prevent arcing and physical damage to the electrical terminal upon being exposed to surge current/voltage. The terminal includes a contact with a base portion from which two spaced apart arms extend outwardly. First portions of the arms are generally parallel to one another. Second portions of the arms converge toward each other and then flare outwardly along third portions of the arms. At the junction of the second and third portions, there is a contact region formed to receive the lead of a surge protection device. The terminal is enclosed in an opening in the electrically insulative housing, the opening being bordered by walls closely adjacent to the first portions of the arms. The spacing of the walls from the arms is about 0.001 inches on each side of the terminal. When the terminal is exposed to a surge current/voltage, the walls stiffen the terminal and prevent arcing and physical damage.

16 Claims, 5 Drawing Sheets

U.S. PATENT DOCUMENTS 3,076,172 A * 1/1963 Carr et al. ..... 439/830
3,467,944 A * 9/1969 Hammell et al. ..... 439/562
3,492,628 A * 1/1970 Matthews ..... 439/81
3,685,001 A * 8/1972 Krafthefer ..... 439/81
4,310,210 A * 1/1982 Takahashi et al. ..... 439/247
4,372,638 A * 2/1983 Sohler ..... 439/857
4,472,016 A * 9/1984 Rodseth ..... 439/856
4,504,883 A 3/1985 Uchida et al.
4,743,208 A * 5/1988 Weisenburger ..... 439/398
4,775,332 A * 10/1988 Bowden et al. ..... 439/650
4,876,621 A * 10/1989 Rust et al. ..... 361/58
5,399,108 A * 3/1995 Lu et al. ..... 439/682
5,508,873 A * 4/1996 Knapp et al. ..... 361/119
5,519,586 A * 5/1996 Byrd ..... 361/833
5,574,614 A 11/1996 Busse et al.
5,595,507 A 1/1997 Braun et al.
5,596,473 A 1/1997 Johnson et al.
5,627,721 A 5/1997 Figueiredo et al.
5,643,014 A 7/1997 Filus et al.
5,779,504 A 7/1998 Dominiak et al.
5,808,859 A * 9/1998 Liang ..... 361/673
5,844,785 A 12/1998 Daoud et al.
5,876,249 A * 3/1999 Kim ..... 439/619
5,923,238 A * 7/1999 Polzehl et al. ..... 337/283
6,007,389 A * 12/1999 Weber ..... 439/857
D424,022 S 5/2000 Polzehl
6,101,079 A * 8/2000 Viklund ..... 361/119
6,166,894 A 12/2000 Kane
6,198,615 B1 * 3/2001 Pelosi et al. ..... 361/119
6,215,638 B1 4/2001 Figueiredo et al.
6,243,250 B1 6/2001 Cater
6,247,959 B1 6/2001 Daoud et al.
6,249,415 B1 6/2001 Daoud et al.
6,315,611 B1 * 11/2001 Sawada et al. ..... 439/619
6,478,637 B1 * 11/2002 Ohkita et al. ..... 439/857
6,554,659 B2 * 4/2003 Kikuchi et al. ..... 439/857
6,556,411 B1 * 4/2003 Hoeft et al. ..... 361/119

* cited by examiner

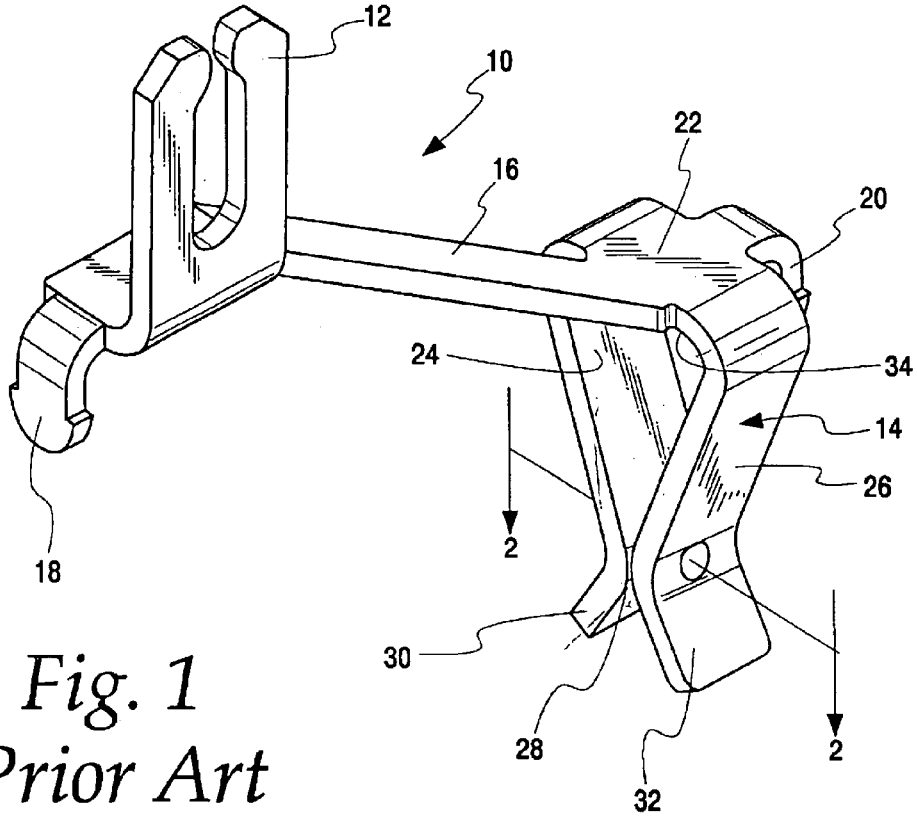
Fig. 1
Prior Art
Fig. 2
Prior Art
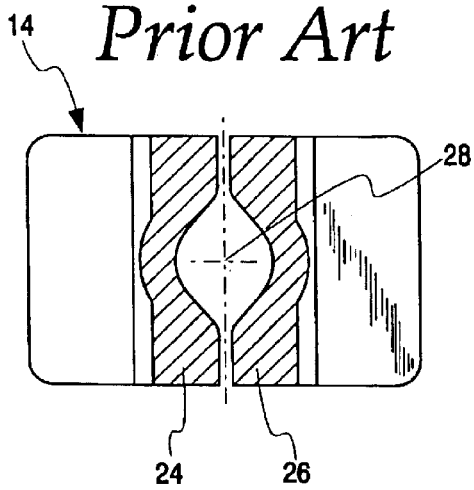

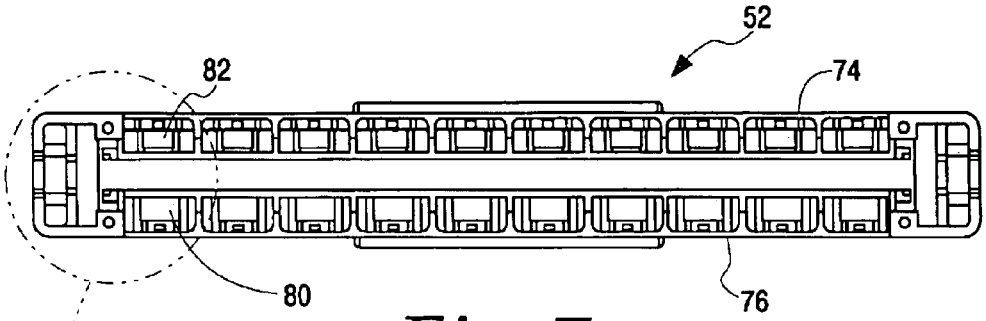
Fig. 7
Fig. 8
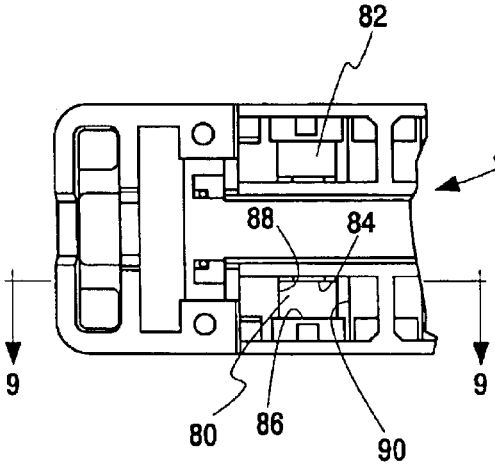
Fig. 8
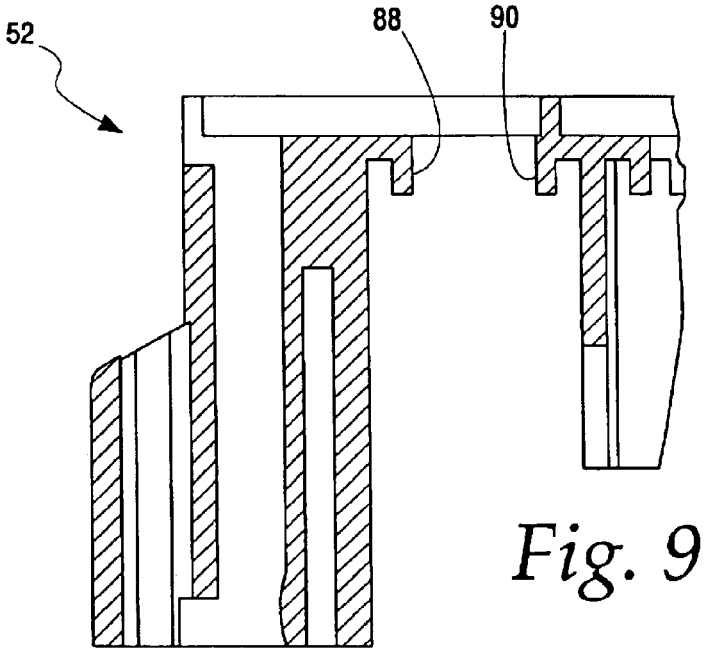
Fig. 9

ELECTRICAL TERMINAL FOR SURGE PROTECTION CARTRIDGE

BACKGROUND OF THE INVENTION

1. Field of the Invention

The present invention relates to an electrical terminal and more particularly to an electrical terminal and housing for use with a surge protection cartridge which is simple, reliable and economical.

2. Description of the Related Art

Surge protection cartridges or modules may be used with modular terminal block assemblies in telecommunication networks as shown and described, for example, in U.S. Pat. Nos. 5,627,721; 5,779,504 and 6,243,250. The surge protection cartridge includes over-voltage/over-current protection devices to protect telecommunication networks from malfunctions and the users of the networks from injury, due to high voltage/high current surges. An important principal of electrical protection is to provide a low impedance path to ground for undesirable or foreign voltages, such as those created by lightning. On a telephone line circuit, current flows into the telephone equipment on the tip lead and returns on the ring lead. Voltage is applied to the telephone line so that the current will flow through the telephone equipment. When the voltage on the line at the protection device raises above a preset level, usually 200–600 volts, a change of state in the protection device occurs and the current flows to ground while the undesirable high voltage is maintained. When high current flows through the contact interface of the protection device and the tip terminal, an electromagnetic force, which is referred to as "repulsion force" or "blow-off", may create a gap at the contact interface. Consequently, electrical arcing may occur and erode the contact surface, and/or weld surfaces together or create a high resistance, or result in an open circuit causing a network malfunction.

An existing tip clip design that has not proven effective is shown in FIGS. 1 and 2. The design is of a tip terminal or clip 10 having a first electrical contact 12, a second electrical contact 14 and a bridge 16. At each end of the tip clip is a connector barb, a right barb 18 and a left barb 20.

The second electrical contact 14 includes a base portion 22, two converging arm portions 24, 26, a contact region 28 and flare portions 29, 30. The width of each arm portion, from a left surface 31 to a right surface 32, is 0.080 inches and the distance from a bottom surface 34 of the base 22 to the contact region is 0.227 inches. The length of the two arms from the base is 0.314 inches. The distance across from arm to arm at its greatest extent is 0.180 inches. The thickness of each arm is 0.020 inches and the material of the clip is Olin Brass C510 phosphor bronze. The clip is plated with electro tin (150–200 micro inches) over nickel (50–100 micro inches) which in turn is plated over copper flash (30–50 micro inches). As seen in FIG. 2, the width of the rounded opening of the contact region is 0.030 inches and the gap between the arms at the contact region is 0.004 inches. The spring constant of the tip clip is 0.073 lb./mil. The diameter of a protection device lead is 0.039 plus or minus 0.001 inches. When such a lead is inserted into the clip, the deformation of the clip is between 0.003–0.006 inches. At these deformations, the contact normal force is 0.45–0.9 pounds.

When the tip clip shown in FIGS. 1 and 2 was tested by exposure to a 10 kA current surge test, there was arcing and physical damage in the contact region.

BRIEF SUMMARY OF THE INVENTION

The difficulties encountered with the previous tip clip have been overcome by the present invention. What is described here is an electrical terminal for a surge protection cartridge used with a standard telecommunication frame, said terminal for receiving a lead of an existing surge protection device and comprising a metal element having a first contact portion, a second contact portion and a spanning portion connecting the first and the second contact portions, the second contact portion including a base and first and second arms extending away from the base, the arms being generally parallel to one another along first portions of the arms, the arms converging toward one another along second portions of the arms, and the arms being flared away from one another along third portions of the arms.

There are a number of advantages, features and objects achieved with the current invention which are believed not to be available in earlier related devices. For example, one advantage is that the present invention provides an electrical terminal or tip clip which is simple, effective and economical. Another object of the present invention is to provide a tip clip with increased normal force at the region of contact with a lead to enhance that contact. Another object of the present invention is to provide a tip clip which does not exhibit arcing and physical damage when exposed to a 10 kA current surge test; the surge does not destroy the electrical contact and the terminal continues to function after the surge event.

A more complete understanding of the present invention, and other objects advantages and features thereof will be gained from a consideration of the following description of the preferred embodiment read in conjunction with the accompanying drawing provided herein. The preferred embodiment represents an example of the invention which is described here in compliance with Title 35 U.S.C. § 112 (1$^{st}$ paragraph).

BRIEF DESCRIPTION OF THE SEVERAL VIEWS OF THE DRAWING

FIG. 1 is an isometric view of a prior art electrical terminal.

FIG. 2 is an enlarged sectional plan view taken along line 2—2 of FIG. 1.

FIG. 7 is a bottom plan view of the housing of FIGS. 5 and 6.

FIG. 8 is an enlarged bottom plan view of a portion of the housing taken within the circle 8—8 of FIG. 7.

FIG. 9 is a sectional elevation view of the housing taken along line 9—9 of FIG. 8.

DETAILED DESCRIPTION OF A PREFERRED EMBODIMENT OF THE INVENTION

Figure 3:
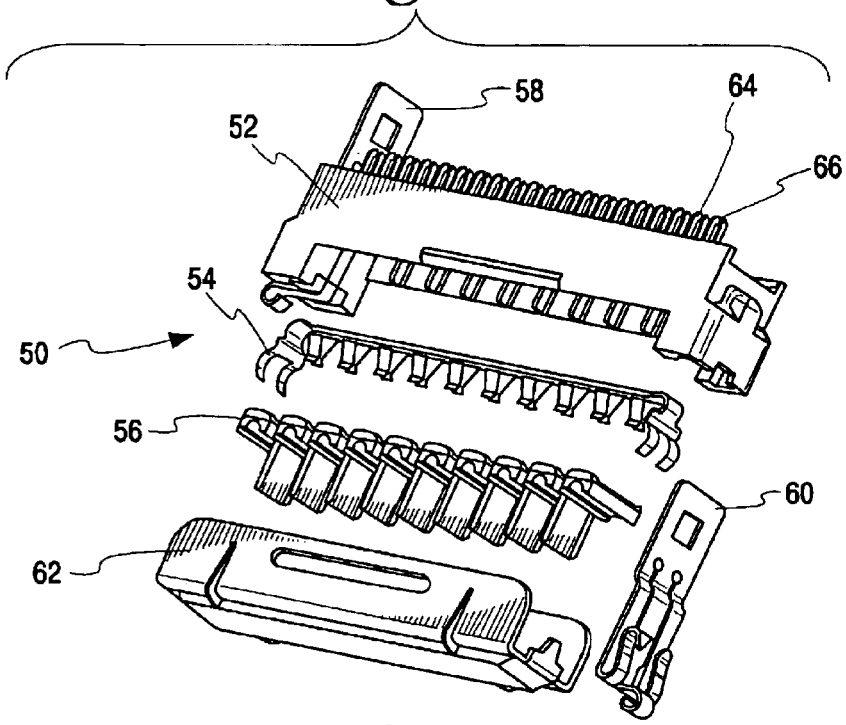
FIG. 3 is a partial exploded isometric view of a surge protection cartridge without protection devices.

While the present invention is open to various modifications and alternative constructions, the preferred embodiment shown in the drawing will be described herein in detail. It is understood, however, that there is no intention to limit the invention to the particular form or example disclosed. On the contrary, the intention is to cover all modifications, equivalent structures and methods, and alternative constructions falling within the spirit and scope of the invention as expressed in the appended claims, pursuant to Title 35 U.S.C. § 112 ($2^{nd}$ paragraph).

Figure 4:
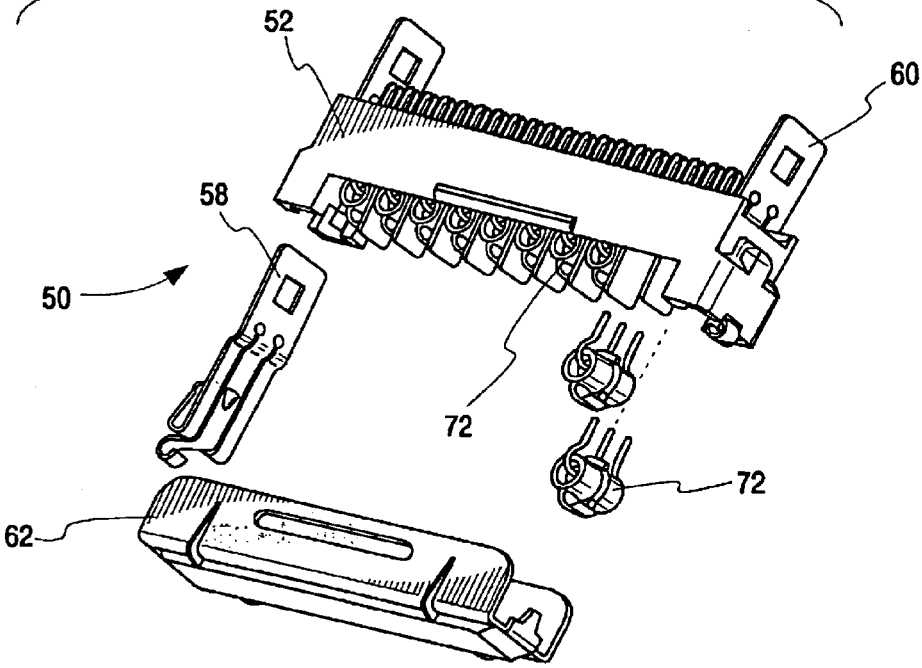
FIG. 4 is a partial exploded isometric view of the surge protection cartridge illustrating the placement of protection devices.
Figure 5:
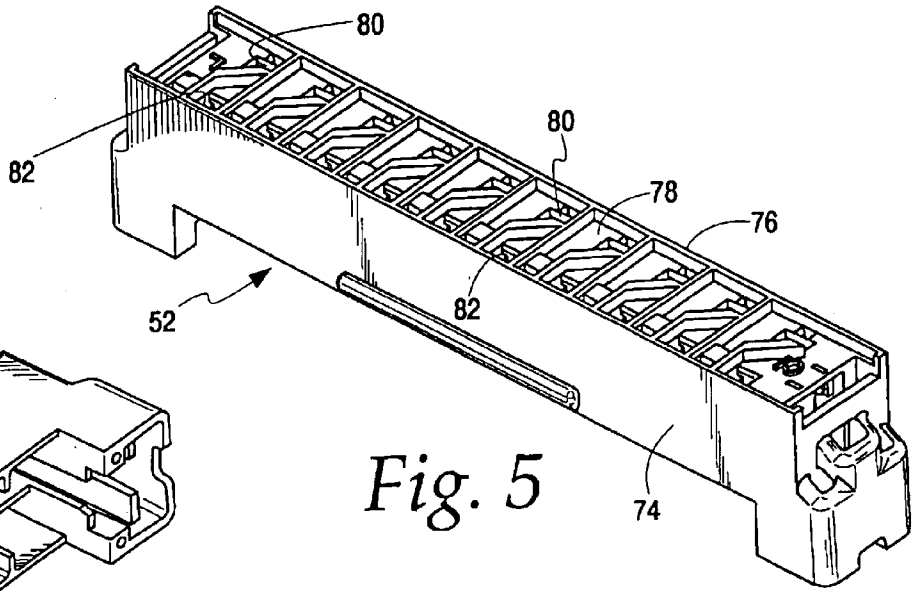
FIG. 5 is a downward-looking isometric view of an electrically insulative housing of the surge protection cartridge.

Referring now to the drawing, an example of the invention as illustrated. In FIG. 3, a surge protection cartridge 50 (but without the protection devices) is illustrated and includes an electrically insulative ten-pair housing 52, a grounding element 54, a guide strip 56, two attachment clips 58, 60, a cover 62 and tip and ring terminals such as the tip terminal or clip 64 and the ring terminal or clip 66. In FIG. 4, the surge protection cartridge is partially assembled and includes surge protection devices such as the devices 70, 72. After the surge protection devices are inserted into the cartridge and the cover attached, a compact, robust module is the result.

Referring now to FIGS. 10–13, an electrical terminal in the form of a tip clip 100 is illustrated. The tip clip is a metal strip having two opposed wide surfaces 101, 103 and opposed narrow edges 105, 107 and includes a first electrical contact 102, a second electrical contact 104 and a spanning bridge portion 106. A first connecting barb 108 is located near the first contact 102 and a second connecting barb 110 is located near the second electrical contact 104.

Referring now to FIGS. 10–13, an electrical terminal in the form of a tip clip 100 is illustrated. The tip clip includes a first electrical contact 102, a second electrical contact 104 and a spanning portion 106. A first connecting barb 108 is located near the first contact 102 and a second connecting barb 110 is located near the second electrical contact 104.

The second electrical contact 104 includes a base portion 112 having opposite ends 109, 111 connected to opposing arms 114, 116 where the arms have first portions 118, 120 which are generally parallel to each other, second portions 122, 124 which are formed to converge toward one another and third flared or diverging portions 126, 128. Between the base ends and the parallel arm portions 118, 120 are a first pair of bends 115, 117 of about ninety degrees. The parallel arm portions extend away from the bends 115, 117. Between the parallel arm portions 118, 120 and the converging arm portions 122, 124 are a second pair of bends 119, 121. The converging arm portions extend away from the bends 119, 121. Between the converging arm portions 122, 124 and the diverging arm portions 126, 128 are a third pair of bends 123, 125 and the diverging arms extend away from the bends 123, 125. A contact region 130 is formed between the arms 114, 116 at approximately the junction of the second and third arm portions. The contact region has generally curved walls 127, 129 on each arm so as to receive a cylindrically shaped lead from a surge protection device. The first portions 118, 120 of the two arms include outer surfaces 132, 134, respectively. These outer surfaces may, under circumstances of a blow-off force caused by lightning, abut the lateral walls 88, 90, FIG. 13 of the housing 52 as shown in broken line in FIG. 14, so as to support and stiffen the tip clip.

The material for the tip clip is Olin Brass C7025 phosphor bronze, a high performance alloy from both mechanical and electrical standpoints, with a thickness of 0.020 inches. The thickness is measured from the surface 136 to the surface 138, FIG. 12. The width of the tip clip arm from a surface 140 to a surface 142 has been expanded in comparison to the tip clip shown FIGS. 1 and 2 from 0.080 to 0.085 inches. The distance from the base to the contact region, however, remains at 0.227 inches. The width of the contact region (the lateral distance between the two curved walls 127, 129) has been reduced from 0.030 to 0.028 inches and the gap between the two arms adjacent the contact region from a surface 136 to a surface 144 has been expanded from 0.004 to 0.008 inches. The clip deformation increases to 0.004–0.007 inches. The distance from the bottom surface 146, FIG. 11 of the base to the end of the first portion of the arms is about 0.091 inches, and this dimension is approximately the same as the depth of the lateral walls 88, 90 of the housing extending from the housing top wall 78. The change of material, dimensions and form results in the spring constant being increased from 0.073 lb./mil to 0.1 lb./mil. The normal force at the contact region increases from 0.8 to 1.4 lbs.

The yield stress of the new material is about 85 to 110 ksi as compared to about 81 ksi for the C510 phosphor bronze used in the tip clip of FIGS. 1. It has been found that the tip clips' working stress is 62.1 ksi without the benefit of the lateral walls. The working stress of the clip will exceed its material yield stress when there is an applied force of between 1.9 and 2.47 lbs. However, under blow-off conditions the tip clip arms will be spread further and will engage the lateral walls of the housing. This abutment stiffens the tip clip. Under these conditions, the clip's working stress will exceed its material yield stress when the applied force is between 3.75 and 4.85 lbs. When tested under a 10 kA current surge, the new design avoided high current arcing and any physical damage.

The tip clip may be formed by a known stamping operation and installed on the housing in a suitable fashion known to those skilled in the art. The cartridge and its elements, including the housing, are more fully described in U.S. Pat. No. 6,556,411.

The portion of the specification above describes in detail a preferred embodiment of the present invention. Other examples, embodiments, modifications and variations will under the literal claim language and the doctrine of equivalents come within the scope of the invention defined by the appended claims. For example, forming surge protection cartridges with greater or lesser pair counts is considered equivalent structures and will also come within the literal language of the claims. Making slight geometric changes will also come within the literal language of the claims. Still other alternatives will also be equivalent as are many new technologies. There is no desire or intention here to limit in any way the application of the doctrines of equivalents nor to limit or restrict the scope of the invention.

What is claimed is:

1. An electrical surge protection terminal system comprising:

a housing having an opening for receiving an electrical terminal; and an electrical terminal in the form of a metal strip having two opposed wide surfaces and two opposed narrow edges, said terminal being mounted to said housing in said opening, said terminal having a first contact structured of said metal strip to have a base portion including two ends, first bends of about 90 degrees integral with each end of said base portion where the axes of the bends are located through the narrow edges and are parallel with said wide surfaces of said strip, generally parallel arm portions integral with said first bends and extending away therefrom wherein a wide surface of each arm faces a wide surface of the other arm, second bends of less than 90 degrees integral with each of said parallel arm portions, converging arm portions integral with said second bends and extending away therefrom, third bends integral with each of said converging arm portions, diverging arm portions integral with said third bends and extending away therefrom, a region of electrical contact at generally the junction of said converging arm portions, said diverging arm portions and said third bends, said region of electrical contact including generally curved walls of wall thicknesses generally the same as said base portion, said parallel arm portions, said converging arm portions and said diverging arm portions, said curved walls forming a generally cylindrical space having a longitudinal axis parallel to said parallel arm portions and perpendicular to said base portion, said cylindrical space for receiving an electrical conductor in a direction parallel to said longitudinal axis.

2. The terminal system as claimed in claim 1 wherein:

said opening in said housing is bordered by walls closely spaced from said electrical terminal wherein movement by said parallel arm portions in response to a surge is constrained.

3. The terminal system as claimed in claim 1 wherein:

exposing said electrical terminal to blow-off force causes said arms of said terminal to abut walls surrounding said opening in said housing wherein said walls strengthen said terminal and allows said terminal to continue functioning after being exposed to said blow-off force.

4. The terminal system as claimed in claim 1 wherein:

said opening in said housing is bordered by walls closely spaced from said electrical terminal, wherein the distance between said terminal parallel arm portions and said walls is about 0.001 inches.

5. The terminal system as claimed in claim 4 wherein:

said region of electrical contact includes generally curved walls shaped with a maximum distance between said curved walls of about 0.028 inches;

adjacent the region of electrical contact, said arm portions are spaced apart by about 0.008 inches; and said metal strip generates between about 0.8 and about 1.4 pounds of normal force upon an inserted conductor into said region of contact.

6. The terminal system as claimed in claim 5 wherein:

each of said arm portions is about 0.085 inches wide and about 0.020 inches thick;

said electrical terminal is comprised of a high performance metal alloy; and said metal alloy has a spring constant of about 0.1 pounds per millimeter.

7. The terminal system as claimed in claim 1 wherein:

said electrical terminal includes a second contact and a bridge spanning said first and said second contacts.

8. The terminal system as claimed in claim 7 wherein:

said opening in said housing is bordered by walls closely spaced from said electrical terminal wherein movement by said parallel arm portions is constrained.

9. The terminal system as claimed in claim 8 wherein:

exposing said electrical terminal to blow-off force causes said parallel arm portions of said terminal to abut walls surrounding said opening in said housing wherein said walls strengthen said terminal and allow said terminal to continue functioning after being exposed to said blow-off force.

10. The terminal system as claimed in claim 1 wherein:

said electrical terminal is formed of phosphor bronze, about 0.02 inches thick and with a width of about 0.80 to 0.085 inches;

said electrical terminal has a deformation of about 0.004 to 0.007 inches upon insertion of said conductor;

said electrical terminal has a yield stress of about 85–110 ksi;

said electrical terminal has a spring constant of about 0.1 pounds per millimeter; and said electrical terminal generates a normal force at said region of electrical contact of about 1.4 pounds.

11. The terminal system as claimed in claim 1 wherein:

said cylindrical space has a width of about 0.028 inches; and adjacent the region of electrical contact, said arms are spaced apart by about 0.008 inches.

12. The terminal system as claimed in claim 1 wherein:

said opening in said housing is bordered by walls having a depth of about 0.091 inches.

13. The terminal system as claimed in claim 1 wherein:

the distance from said base portion to the junction of said converging arm portions, said diverging arm portions and said third bends is about 0.227 inches.

14. The terminal system as claimed in claim 1 wherein:

said electrical terminal is formed of phosphor bronze, about 0.02 inches thick and with a width of about 0.800 to 0.085 inches;

said electrical terminal has a deformation of about 0.004 to 0.007 inches upon insertion of said conductor;

said electrical terminal has a yield stress of about 85–110 ksi;

said electrical terminal has a spring constant of about 0.1 pounds per millimeter;

said electrical terminal generates a normal force at said region of electrical contact of about 1.4 pounds;

said cylindrical space has a width of about 0.028 inches; and adjacent the region of electrical contact, said arms are spaced apart by about 0.008 inches.

15. The terminal system as claimed in claim 14 wherein:

said opening in said housing is bordered by walls having a depth of about 0.091 inches.

16. The terminal system as claimed in claim 15 wherein:

the distance from said base portion to the junction of said converging arm portions, said diverging arm portions and said third bends is about 0.227 inches.

* * * * *

UNITED STATES PATENT AND TRADEMARK OFFICE

CERTIFICATE OF CORRECTION

PATENT NO. : 6,814,631 B2
APPLICATION NO. : 10/114138
DATED : November 9, 2004
INVENTOR(S) : Thomas Baum et al.

Figure 14:
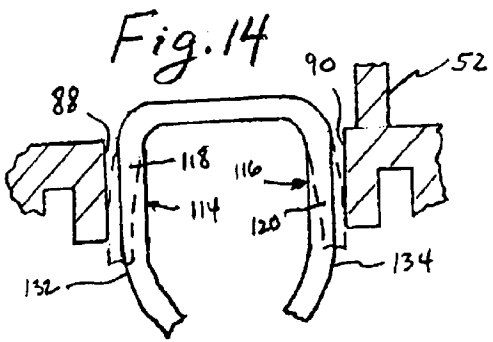
Figure 6:
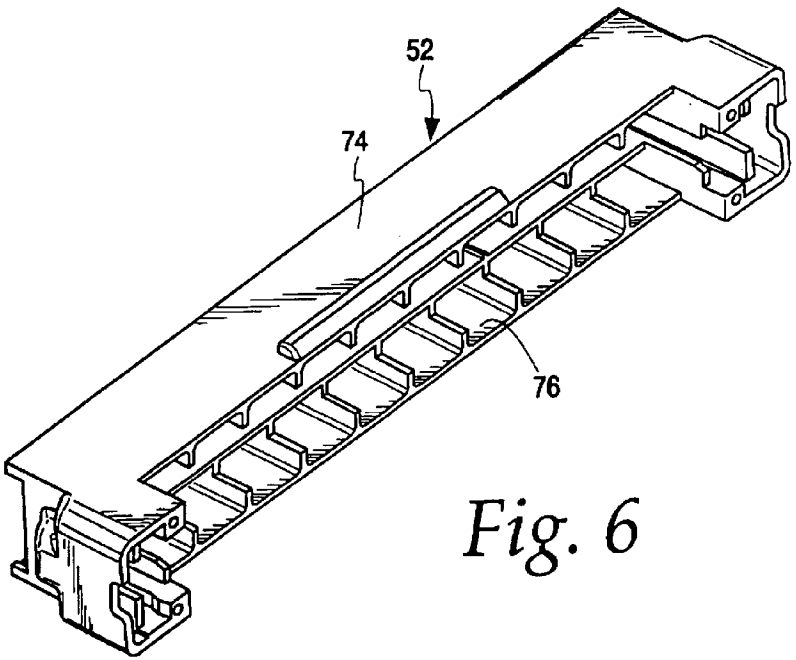
FIG. 6 is an upward-looking isometric view of the housing of FIG. 5.
Figure 10:
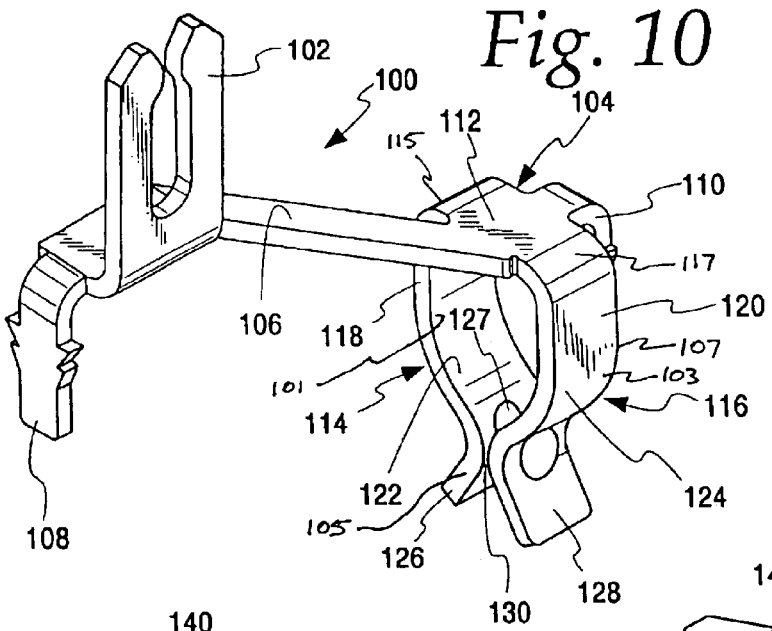
FIG. 10 is an isometric view of an example of the electrical terminal of the present invention.
Figure 12:
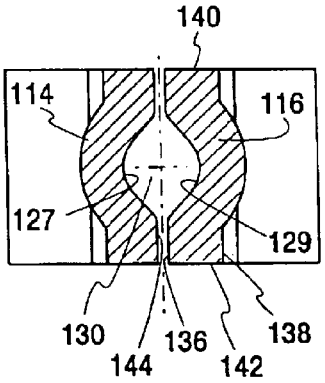
FIG. 12 is an enlarged sectional plan view taken along line 12—12 of FIG. 11.
Figure 11:
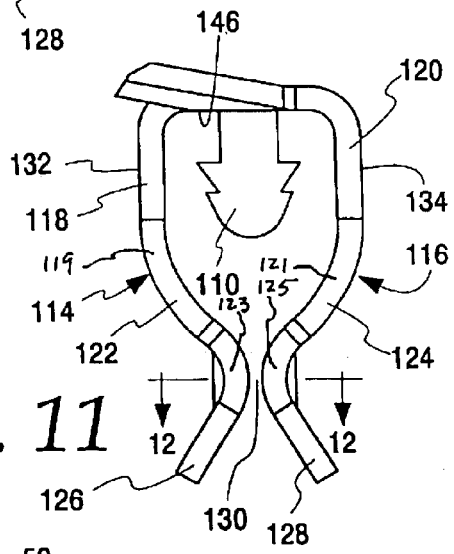
FIG. 11 is an enlarged front elevation view of a portion of the electrical terminal shown in FIG. 10.
Figure 13:
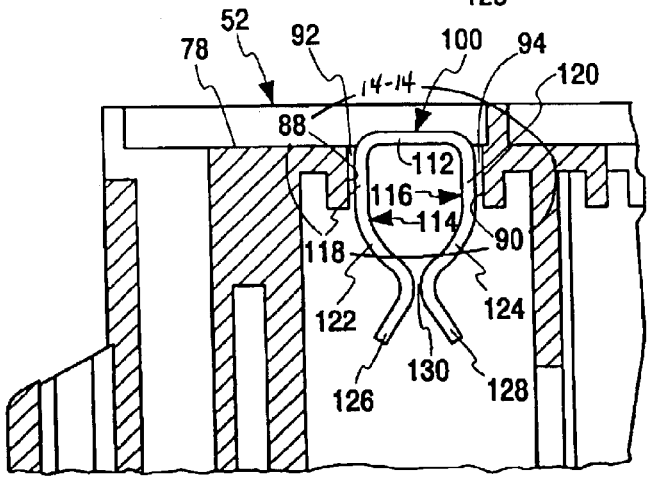
FIG. 13 is an enlarged view of a portion of the housing shown in FIG. 9 with a mounted electrical terminal.

It is certified that error appears in the above-identified patent and that said Letters Patent is hereby corrected as shown below:

In the specification:

At column 2, line 62, replace “FIG. 13 is an enlarged view” with --FIG. 13 is a view--;
At column 2, line 63, insert --FIG. 14 is an enlarged view of a portion of FIG. 13 taken within the oval 14-4.--;
At column 3, line 36, replace reference numeral “109” with --126--;
At column 3, line 36, replace reference numeral “111” with --128--; and
At column 3, line 54, replace “lead” with --conductor--.

Signed and Sealed this

Eighteenth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 6,814,631 B2
APPLICATION NO. : 10/114138
DATED : November 9, 2004
INVENTOR(S) : Thomas Baum et al.

It is certified that error appears in the above-identified patent and that said Letters Patent is hereby corrected as shown below:

In claim 6, at column 5, line 45, replace “milllimeter” with --mil--.
In claim 10, at column 6, line 7, replace “0.80” with --0.080--.
In claim 10, at column 6, line 14, replace “milllimeter” with --mil--.
In claim 14, at column 6, line 31, replace “0.80” with --0.080--.
In claim 14, at column 6, line 38, replace “milllimeter” with --mil--.

Signed and Sealed this

Twelfth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 6,814,631 B2
APPLICATION NO. : 10/114138
DATED : November 9, 2004
INVENTOR(S) : Thomas Baum et al.

It is certified that error appears in the above-identified patent and that said Letters Patent is hereby corrected as shown below:

Column 3, lines 28-33 delete the text "Referring now to FIGS. 10-13, an electrical terminal in the form of a tip clip 100 is illustrated. The tip clip includes a first electrical contact 102, a second electrical contact 104 and a spanning portion 106. A first connecting barb 108 is located near the first contact 102 and a second connecting barb 110 is located near the second electrical contact 104".

Signed and Sealed this

Seventeenth Day of March, 2009

John Doll

JOHN DOLL
*Acting Director of the United States Patent and Trademark Office*